US005769668A

United States Patent [19]

Tondreault

[11] Patent Number: 5,769,668

[45] Date of Patent: Jun. 23, 1998

[54] MODULE ALIGNMENT APPARATUS FOR AN ELECTRICAL CONNECTOR

[75] Inventor: Robert J. Tondreault, Louisville, Ky.

[73] Assignee: Robinson Nugent, Inc., New Albany, Ind.

[21] Appl. No.: 612,545

[22] Filed: Mar. 8, 1996

[51] Int. Cl.[6] ..... H01R 23/70

[52] U.S. Cl. ..... 439/633; 439/326; 439/680

[58] Field of Search ..... 439/327, 328, 439/374, 378, 680–681, 633, 326, 64

[56] References Cited

U.S. PATENT DOCUMENTS

| | | | |
|---|---|---|---|
| 2,911,609 | 11/1959 | Burtt et al. . | |
| 3,533,045 | 10/1970 | Henschen | 439/17 |
| 4,533,189 | 8/1985 | Scoccia et al. . | |
| 4,713,013 | 12/1987 | Regnier et al. | 439/328 |
| 4,826,446 | 5/1989 | Juntwait . | |
| 4,869,672 | 9/1989 | Andrews, Jr. . | |
| 4,999,744 | 3/1991 | Blankenship . | |
| 5,162,002 | 11/1992 | Regnier . | |
| 5,184,961 | 2/1993 | Ramirez et al. . | |
| 5,197,887 | 3/1993 | Davidge et al. . | |
| 5,207,598 | 5/1993 | Yamada et al. . | |
| 5,240,420 | 8/1993 | Roberts . | |
| 5,295,852 | 3/1994 | Renn et al. . | |
| 5,308,249 | 5/1994 | Renn et al. . | |
| 5,387,115 | 2/1995 | Kozel et al. | 439/328 |
| 5,389,000 | 2/1995 | DiViesti et al. | 439/328 |
| 5,405,267 | 4/1995 | Koegel et al. . | |
| 5,411,402 | 5/1995 | Bethurum . | |

*Primary Examiner*—Neil Abrams
*Assistant Examiner*—Katrina Davis
*Attorney, Agent, or Firm*—Barnes & Thornburg

[57] ABSTRACT

An electrical connector apparatus is provided for electrically coupling a module having an end edge including a keyway and a plurality of conductive pads to a plurality of conductive traces on a mother printed circuit board. The apparatus comprises an insulative housing formed to include an elongated slot for receiving the end edge of the module, a plurality of contacts located in the slot for engaging the conductive pads on the module, and a key formed integrally with the insulative housing. The key has first and second side walls which are formed to include first and second recessed slots, respectively. The apparatus also includes an alignment clip coupled to the key. The alignment clip includes a body portion and first and second spring beams positioned in the first and second slots of the key. The first and second spring beams each have a head portion which extends outwardly from the first and second recessed slots, respectively, and beyond the first and second walls of the key to engage the keyway during insertion of the module into the elongated slot of the housing.

18 Claims, 5 Drawing Sheets

MODULE ALIGNMENT APPARATUS FOR AN ELECTRICAL CONNECTOR

BACKGROUND AND SUMMARY OF THE INVENTION

The present invention relates to an electrical connector configured to receive a card or module therein to couple the module electrically to a mother printed circuit board. More particularly, the present invention relates to an electrical connector having an alignment apparatus for centering the module relative to the connector during insertion of the module into the connector to align conductive pads on the module with electrical contacts of the connector.

It is well known to provide card-edge or memory module electrical connector sockets for electrically coupling a main mother printed circuit board to a baby printed circuit board known as a card or module. As electrical components get smaller and smaller, spacing between contacts of the electrical connector and between the conductive pads on the module is reduced. Tighter locational tolerances are required on the connector in order to ensure matability between the contacts of the connector and the pads of the module. In many cases, however, at least one of the mating components cannot be held to the very specific tolerances which are required due to manufacturing limitations.

It is known to provide a slot or keyway in a module which is configured to mate with an alignment post or key formed in the connector socket to provide polarization and alignment between the module and the socket. In conventional connectors, the selected clearance gap between the keyway and the key, plus the manufacturing tolerances of both the keyway and the key, did not cause misalignment of the conductive pads of the module with the contacts of the electrical connector.

Under normal manufacturing tolerances, the keyway formed in the module has a width of about 1.50 mm +/−0.10 mm. The key formed on the socket connector has a width of 1.35 mm +/−0.05 mm. Therefore, the maximum clearance between the keyway formed in the module and the key in the socket is 0.15 mm +/−0.15 mm due to manufacturing tolerances. In other words, a 0.30 mm clearance gap is passible between the keyway of the module and the key formed in the socket due to the manufacturing tolerances. When the width of each conductive pad formed on the module is reduced to a width below 0.85 mm, this 0.30 mm clearance gap can cause misalignment between the conductive pads on the module and the contacts on the electrical connector.

A module which is now being standardized within the electronics industry requires tightly controlled features not only on the module, but also on the electrical connector socket. This new module has reduced spacing between adjacent conductive pads on the module of 0.80 mm. Current module manufacturing capabilities cannot meet these tight requirements without incurring tremendous costs.

The present invention provides an improved module alignment apparatus which solves the problems caused by loose tolerances and clearance gaps between the keyway of the module and the key formed in the electrical connector.

The present invention is designed to reduce, minimize, or even eliminate the clearance gap problem between the keyway formed in the module and the key formed in the socket. The present invention provides a flexible and collapsible key in the socket which is wider than the keyway of the connector socket. Preferably, the flexible key has at least two spring members that have a combined width wider than the keyway formed in the module. The flexible key compresses during insertion of the module into the socket to eliminate the clearance gap between the keyway and the key and ensure alignment between the pads of the module and the contacts of the connector.

The improved alignment or centering apparatus of the present invention reduces or eliminates the tolerance problem between the module keyway and the socket key. The apparatus of the present invention includes spring beams which are configured so that regardless of the size of the keyway formed in the module or the key formed in the connector, the spring arms interfere with the keyway during insertion of the module into the socket. The spring beams are symmetrically shaped so that the spring forces of both beams are equivalent, thereby centering the keyway relative to the alignment apparatus. Since the alignment apparatus is located properly with respect to the socket contacts, the manufacturing tolerances are "absorbed" by the spring beams so that the mating module is centered relative to the socket.

The present invention provides a low cost solution to the module alignment problem. The solution is transparent to the user so that the module is inserted into the socket in a standard manner. The module alignment apparatus is either made from a separate metal stamping or is formed as an integrally molded in feature of the socket. In the embodiment which includes a metal stamping, a separate metal clip is inserted into and retained by the plastic housing of the socket adjacent a key formed in the socket for receiving the keyway of the module.

According to one aspect of the present invention, an electrical connector apparatus is provided for electrically coupling a module having an end edge including a keyway and a plurality of conductive pads to a plurality of conductive traces on a mother printed circuit board. The apparatus comprises an insulative housing formed to include an elongated slot for receiving the end edge of the module, a plurality of contacts located in the slot for engaging the conductive pads on the module, and an alignment apparatus including at least one movable spring beam for engaging the keyway of the module during insertion of the module into the elongated slot to align the module relative to the housing.

In the illustrated embodiment, the alignment apparatus includes a key formed integrally with the insulative housing and an alignment clip coupled to the key. The alignment clip including at least one movable spring beam for engaging the keyway of the module to align the module relative to the housing. Illustratively, the alignment clip is formed to include a body portion and first and second movable spring beams which are positioned adjacent opposite side walls of the key. The first and second spring beams of the alignment clip include head portions for engaging the keyway of the module during insertion of the module into the elongated slot of the housing. The body portion of the alignment clip is formed to include barbs for securing the alignment clip to the insulative housing.

Also in the illustrated embodiment, the opposite side walls of the key are formed to include first and second recessed slots for receiving the first and second spring beams, respectively. The head portions of the first and second spring beams extend outwardly from the first and second slots formed in the key to engage the keyway of the module. The first and second spring beams of the alignment clip are symmetrical so that the first and second spring beams apply substantially equal spring forces to the keyway of the module to align the module relative to the key and the housing.

According to another aspect of the present invention, an electrical connector apparatus is provided for electrically coupling a module having an end edge including a keyway and a plurality of conductive pads to a plurality of conductive traces on a mother printed circuit board. The apparatus comprises an insulative housing formed to include an elongated slot for receiving the end edge of the module, a plurality of contacts located in the slot for engaging the conductive pads on the module, and a key formed integrally with the insulative housing. The key has first and second side walls which are formed to include first and second recessed slots, respectively. The apparatus also includes an alignment clip coupled to the key. The alignment clip includes a body portion and first and second spring beams positioned in the first and second slots of the key. The first and second spring beams each have a head portion which extends outwardly from the first and second recessed slots, respectively, and beyond the first and second walls of the key to engage the keyway during insertion of the module into the elongated slot of the housing.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying Figures in which.

DETAILED DESCRIPTION OF DRAWINGS

Figure 1:
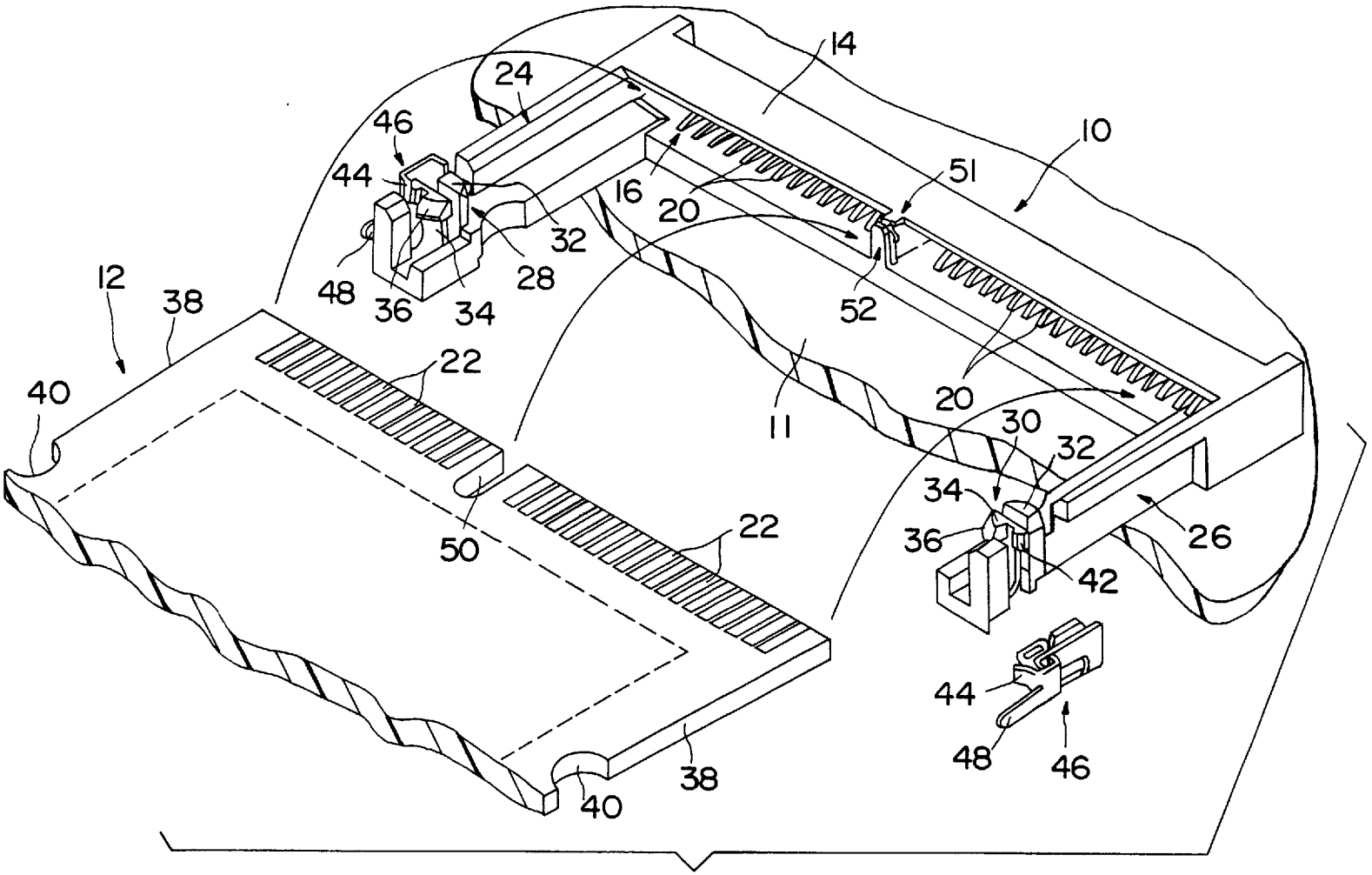
FIG. 1 is a perspective view illustrating an electrical connector socket of the present invention for receiving a printed circuit board or module.

Referring now to the drawings, FIG. 1 illustrates a first embodiment of an electrical connector 10 for coupling a mother printed circuit board 11 to an inserted baby printed circuit board, referred to as card or module 12. The connector 10 includes an insulative plastic housing 14 having an elongated slot 16 for receiving an end edge 18 of module 12. Connector 10 includes a plurality of contacts 20 configured to engage conductive pads 22 formed on both sides of module 12 adjacent end edge 18 to couple the module 12 to the mother printed circuit board 11 electrically through the connector 10.

The connector 10 includes first and second side arms 24 and 26, respectively. The first and second side arms 24 and 26 are formed to include module locking mechanisms 28 and 30, respectively. Locking mechanisms 28 and 30 are similar to the locking mechanisms disclosed in U.S. application Ser. No. 08/493,353, filed Jun. 21, 1995, the disclosure of which is expressly incorporated herein by reference. Locking mechanisms 28 and 30 are formed integrally from the same plastic material as side arms 24 and 26, respectively. Locking mechanisms 28 and 30 are formed as a split peg including a first, rigid member 32 and a cantilevered locking member 34. Rigid members 32 have the shape of a quarter cylinder. Locking members 34 include a ramp shaped locking head 36. Ramp shaped heads 36 are configured to engage the module 12 and move toward slot 16 during insertion of the module 12. Therefore, the heads 34 overlap portions of side edges 38 of module 12 adjacent side notches 40 when the module 12 is rotated within the connector 10 to the position of FIG. 5. Rigid members 32 are located adjacent side notches 40 to help position and lock the module 12 in connector 10.

Locking members 34 are also formed to include unlocking ramp surfaces 42. Each ramp surface 42 is configured to be engaged by an actuator section 44 of a metal clip 46. When the clips 46 are depressed inwardly, engagement of actuator sections 44 forces the locking members 34 toward the elongated slot 16 of connector 10 to unlock the module 12. Metal clips 46 are formed from a stamped piece of flat sheet metal. The metal clips 46 are coupled to side arms 24 and 26 of housing 14. The clips 46 include actuator sections 48 to facilitate unlocking of the module 12.

Module 12 is formed to include an elongated slot or keyway 50 adjacent end edge 18. Keyway 50 is used for polarization of the module 12 and for aligning the module 12 relative to the electrical connector 10 to ensure that the conductive pads 22 are aligned with proper contacts 20 of the connector 10. Connector 10 is formed to include an alignment apparatus 51 including post or key 52 for receiving keyway 50 of module 12.

Figure 3:
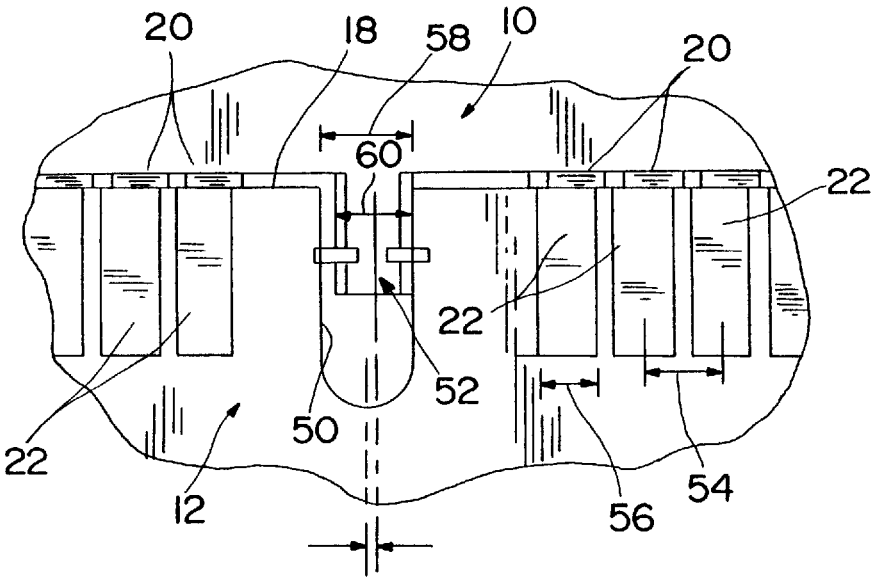
FIG. 3 is a partial top plan view illustrating operation of the module alignment apparatus to align the module relative to the connector during insertion of the module.

Standards in the electronics industry continue to reduce the spacing between adjacent conductive pads 22 of the module 12. As best illustrated in FIG. 3, the conductive leads or pads 22 have centers which are spaced apart a distance of 0.80 mm as illustrated by dimension 54. The pads 22 have a width illustrated by dimension 56 of 0.60 mm +/−0.05 mm. The keyway 50 has a width illustrated by dimension 58 of 1.50 mm +/−0.10 mm. The key 52 of connector 10 has a width of 1.35 mm +/−0.05 mm as illustrated by dimension 60 of FIG. 3.

Typically, the clearance gap between the keyway 50 of module 12 and the key 52 of connector 10 due to manufacturing tolerances did not cause any noticeable misalignment between the module 12 and the connector 10. However, as the width of spacing of pads 22 of module 12 is reduced below about 0.85 mm, the possible clearance gap due to manufacturing tolerances may cause the contacts 20 of the connector 10 to engage the wrong pads 22 of the module 12.

Figure 2:
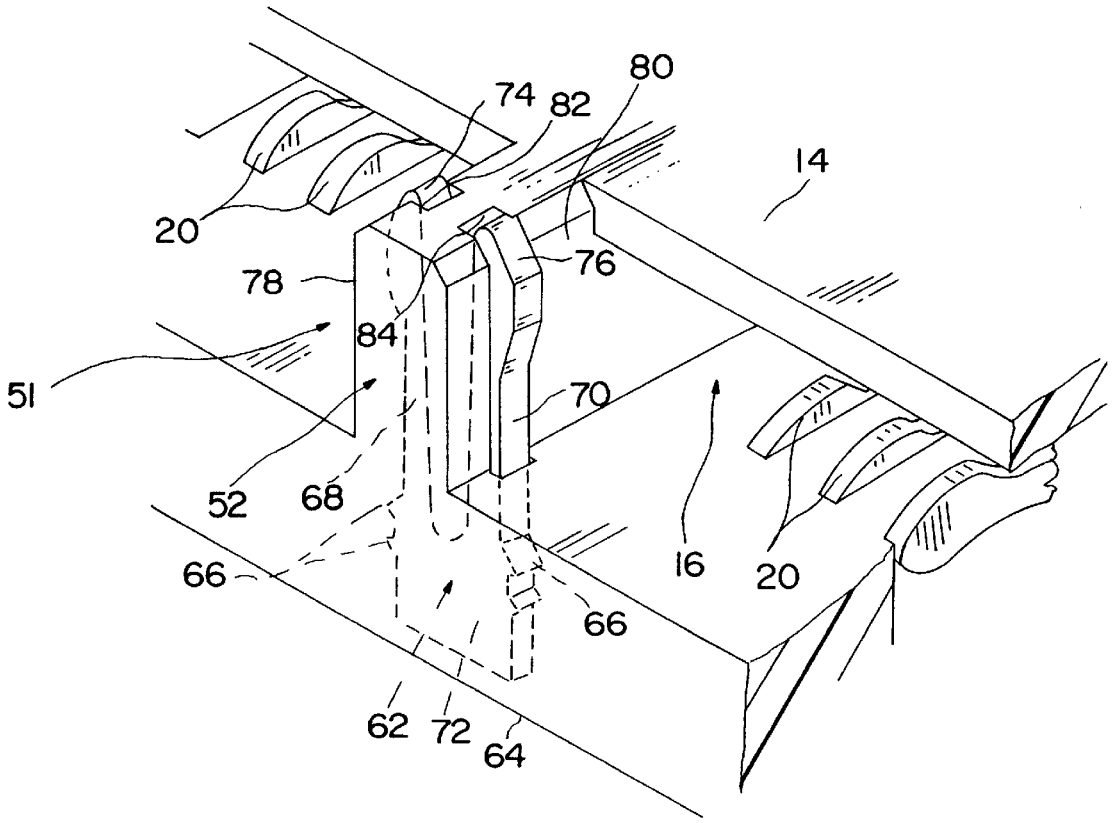
FIG. 2 is an enlarged perspective view of a module alignment and centering apparatus of the present invention located on the electrical connector socket of FIG. 1.

In order to reduce the likelihood of misalignment of the module 12 and to center the module 12 relative to the connector 10, the present invention provides an alignment apparatus 51 which includes an alignment clip 62 as best illustrated in FIG. 2. The clip 62 is inserted into an opening formed in bottom surface 64 of connector 10. Barbs 66 formed on a body portion 72 of the alignment clip 62 are configured to engage the plastic housing 14 to retain the alignment clip 62 within the housing 14.

The alignment clip 62 includes first and second spring beams 68 and 70 extending upwardly from body portion 72. Heads 74 and 76 provide ramp shaped lead-in surfaces on spring beams 68 and 70, respectively. Key 52 includes a pair of spaced apart side walls 78 and 80. Slots 82 and 84 are formed in key 52 for receiving spring beams 60 and 70, respectively. Spring beams 68 and 70 are formed so that the heads 74 and 76 extend outwardly beyond side walls 78 and 80, respectively, of the key 52. The spring beams 68 and 70 are configured so that heads 74 and 76 interfere with the keyway 50 of the module 12 during insertion of the module 12 into the elongated slot 16 of connector 10. The spring beams 68 and 70 are symmetrically shaped so that the spring forces applied by each beam 68 and 70 are equivalent, thereby centering the keyway 50 relative to the alignment apparatus 51. Location of the alignment clip 62 is set properly by the key 52. Therefore, the alignment clip 62 minimizes or eliminates the effects of tolerances between the module 12 and the housing 14. The alignment clip 62 provides a low cost solution to the module alignment problem. The solution is transparent or unknown to the end user of the connector 10.

Positioning of the spring beams 68 and 70 within slots 82 and 84 of key 52, respectively, stabilizes the spring beams 68 and 70 and protects the spring beams 68 and 70 from damage due to insertion of the module 12. The shape of heads 74 and 76 of alignment clip 62 permits the module 12 to be inserted at various angles relative to the connector 10. This feature makes the alignment apparatus 51 user friendly.

Figure 4:
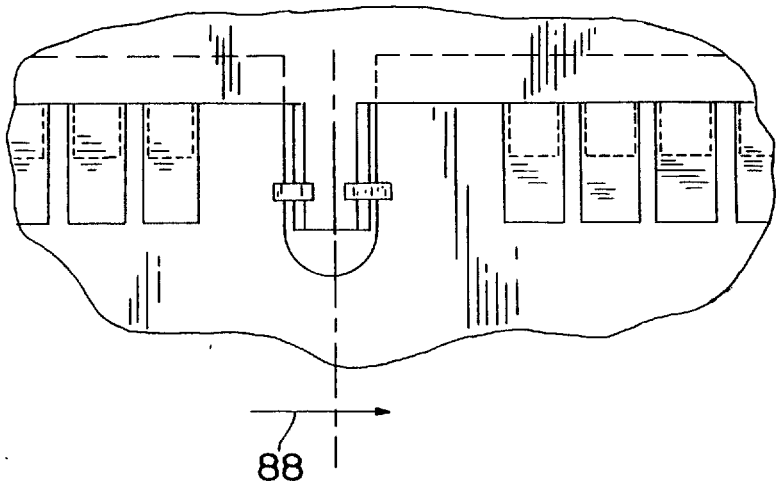
FIG. 4 is a partial top plan view similar to FIG. 3 in which the module has been centered relative to the connector socket by the alignment apparatus.

Operation of the alignment apparatus 51 of the present invention is best illustrated in FIGS. 3 and 4. In FIG. 3, the module 12 is inserted into connector 10 in an off-center position. Keyway 50 of module 12 engages heads 74 and 76 of alignment clip 62 as shown in FIG. 3. The spring forces of spring beams 68 and 70 cause the module 12 to shift in the direction of arrow 88 of FIG. 4 so that the module 12 is centered relative to the connector 10. This ensures proper alignment between the conductive pads 22 and the contacts 20.

Figure 5:
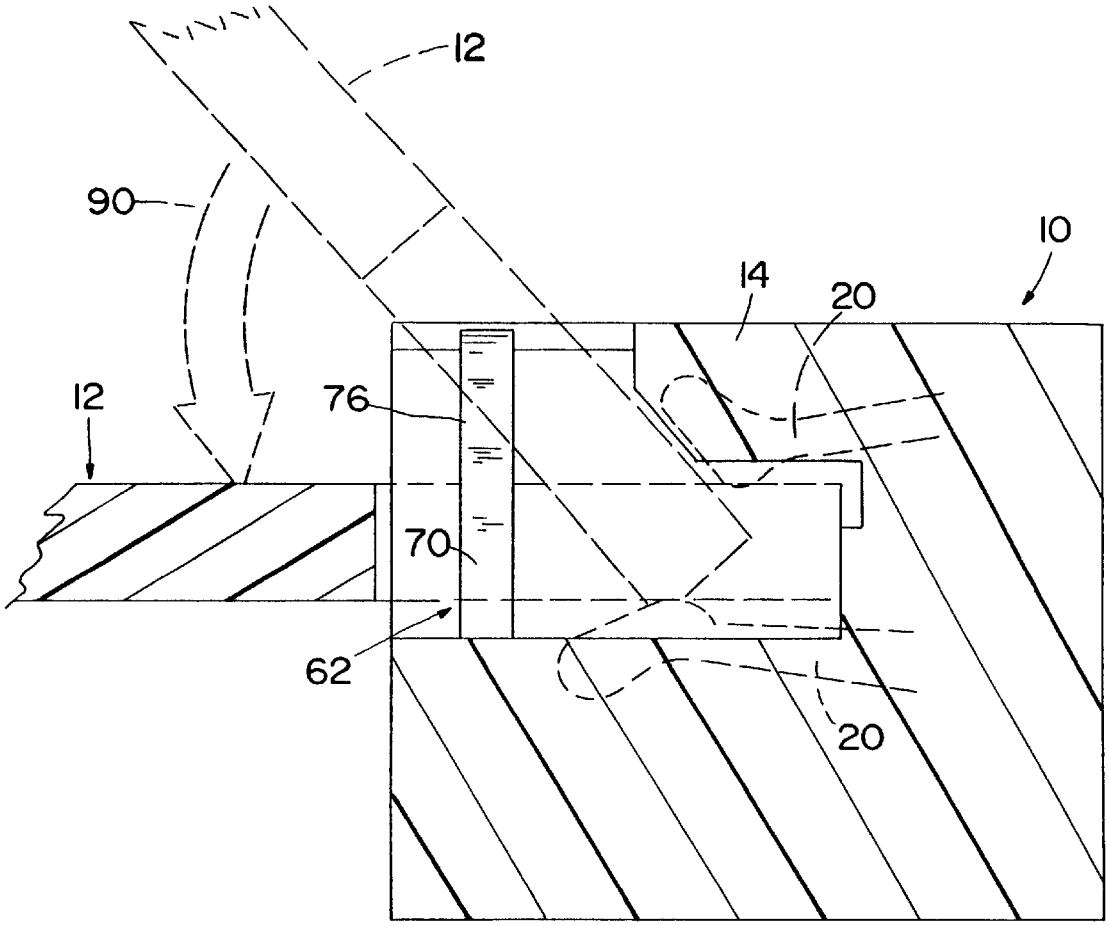
FIG. 5 is a sectional view taken through the connector socket of FIG. 1 further illustrating operation of the alignment apparatus during insertion of the module into the connector socket.

The module 12 is typically inserted into the connector 10 at an angle as illustrated in FIG. 5. The alignment apparatus 51 provides initial alignment or centering between the module 12 and the connector 10 to ensure proper alignment and mating between the conductive pads 22 of the module 12 and contacts 20 of the connector 10. After the module is initially aligned by the alignment apparatus 51, the module 12 is rotated downwardly in the direction of arrow 90 of FIG. 5 to the locked position illustrated by the solid lines of FIG. 5. In the locked position, all the contacts 20 are engaged with the proper pads 22 of the module 12. Locking members 34 snap into position overlapping a portion of the side edges 38 of module 12 adjacent to side notches 40 to retain the module 12 within the socket connector 10.

Figure 6:
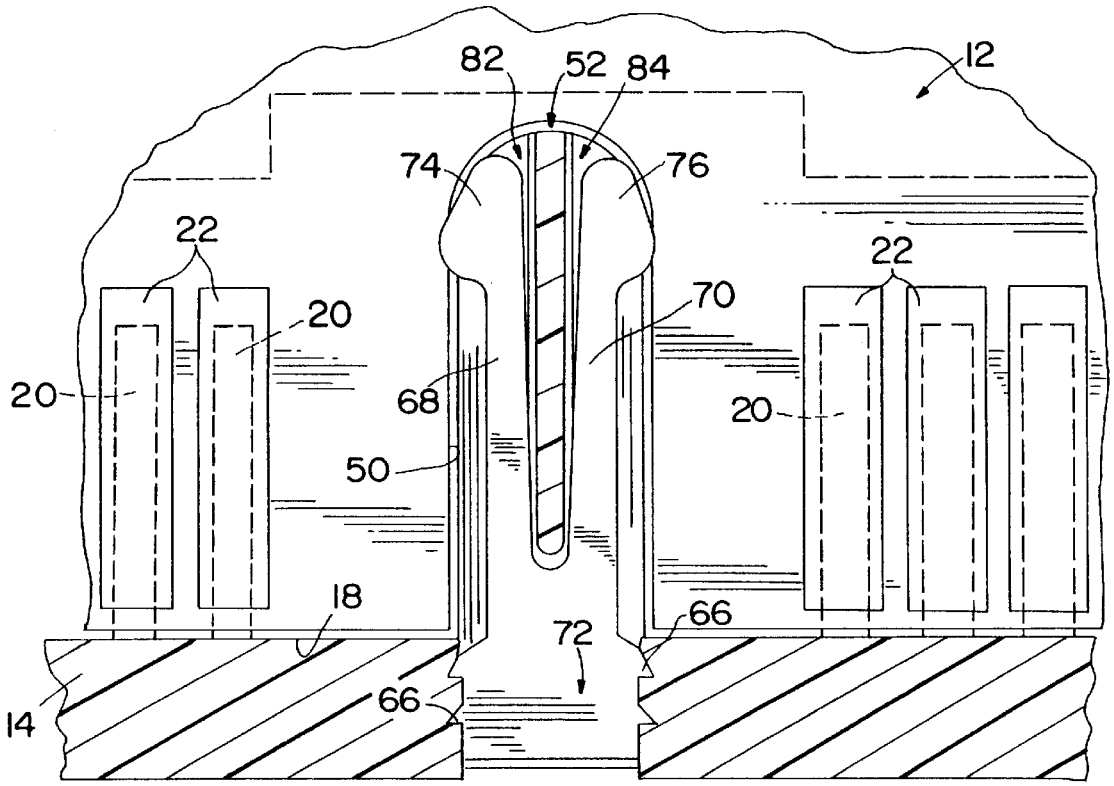
FIG. 6 is a sectional view illustrating another embodiment of the present invention in which spring beams of the module alignment apparatus extend generally parallel to the inserted module.

It is understood that the alignment clip 60 of the present invention may also be used when the spring beams 68 and 70 are located in an orientation which is generally parallel to the inserted module 12. This embodiment is illustrated in FIG. 6. Therefore, the alignment clip 62 of the present invention can align and center a module 12 relative to a connector 10, regardless of the manner or direction in which the module 12 is inserted into the connector 10.

It is understood that the alignment apparatus 52 may include spring beams which are integrally molded with housing 14. In this case, the metal clip 62 would not be used. If the spring beams of alignment apparatus are formed integrally with the housing 14 of connector 10, the key preferably has thin, flexible, compressive walls to absorb the tolerance between the key and the keyway 50 of module 12.

Although the invention has been described in detail with reference to certain preferred embodiments, variations and modifications exist within the scope and spirit of the present invention as described and defined in the following claims.

What is claimed is:

1. An electrical connector apparatus for electrically coupling a module having an end edge including a keyway and a plurality of conductive pads to a mother printed circuit board, the apparatus comprising an insulative housing formed to include an elongated slot configured to receive the end edge of the module, a plurality of contacts located in the slot which are configured to engage the conductive pads on the module, and an alignment apparatus including a key formed integrally with the insulative housing and an alignment clip coupled to the key, the alignment clip including at least one movable spring beam configured to engage the keyway of the module during insertion of the module into the elongated slot to align the module relative to the housing.

2. The apparatus of claim 1, wherein the alignment clip is formed to include a body portion and first and second movable spring beams which are positioned adjacent opposite side walls of the key, the first and second spring beams including head portions configured to engage the keyway of the module during insertion of the module into the elongated slot of the housing.

3. The apparatus of claim 2, wherein the body portion of the alignment clip is formed to include barbs configured to secure the alignment clip to the insulative housing.

4. The apparatus of claim 2, wherein the opposite side walls of the key are formed to include first and second recessed slots configured to receive the first and second spring beams, respectively.

5. The apparatus of claim 4, wherein the head portions of the first and second spring beams extend outwardly from the first and second slots formed in the key to engage the keyway of the module.

6. The apparatus of claim 2, wherein the first and second spring beams of the alignment clip are symmetrical so that the first and second spring beams apply substantially equal spring forces to the keyway of the module to align the module relative to the key and the housing.

7. The apparatus of claim 1, wherein the conductive pads of the module are spaced apart from adjacent conductive pads by a distance of 0.80 mm or less.

8. The apparatus of claim 1, wherein the conductive pads of the module have a width of 0.60 mm or less.

9. In an electrical connector apparatus including an insulative housing formed to include an elongated slot for receiving an end edge of a module, the connector also including a plurality of contacts located in the slot for engaging a plurality of conductive pads on the module to couple the module electrically to a mother printed circuit board, the improvement comprising an alignment apparatus on the housing, the alignment apparatus including a key formed integrally with the insulative housing and an alignment clip coupled to the key, the alignment clip including a body portion having first and second spring beams which are positioned adjacent opposite side walls of the key, the first and second spring beams each including a head portion configured to engage the first and second sides of the keyway of the module during insertion of the module into the elongated slot of the housing to center the module relative to the housing and to align the conductive pads of the module with the contacts of the electrical connector.

10. The apparatus of claim 9, wherein the body portion of the alignment clip is formed to include barbs for securing the spring clip to the insulative housing.

11. The apparatus of claim 9, wherein the opposite side walls of the key are formed to include first and second recessed slots for receiving the first and second spring beams, respectively.

12. The apparatus of claim 11, wherein the head portions of the first and second spring beams extend outwardly from the first and second slots formed in the key to engage the first and second sides of the keyway.

13. The apparatus of claim 9, wherein the first and second spring beams of the alignment clip are symmetrical so that the first and second spring beams apply substantially equal spring forces to the keyway of the module to align the module relative to the key and the housing.

14. An electrical connector apparatus for electrically coupling a module having an end edge including a keyway and a plurality of conductive pads to a mother printed circuit board, the apparatus comprising an insulative housing formed to include an elongated slot for receiving the end edge of the module, a plurality of contacts located in the slot for engaging the conductive pads on the module, a key formed integrally with the insulative housing, the key having first and second side walls which are formed to include first and second recessed slots, respectively, and an alignment clip coupled to the key, the alignment clip including a body portion and first and second spring beams positioned in the first and second slots of the key, the first and second spring beams each having a head portion which extends outwardly from the first and second recessed slots, respectively, and beyond the first and second walls of the key to engage the keyway during insertion of the module into the elongated slot of the housing.

15. The apparatus of claim 14, wherein the body portion of the alignment clip is formed to include barbs configured to secure the alignment clip to the insulative housing.

16. The apparatus of claim 14, wherein the first and second spring beams of the alignment clip are symmetrical so that the first and second spring beams apply substantially equal spring forces to the keyway of the module to align the module relative to the key and the housing.

17. The apparatus of claim 14, wherein the conductive pads of the module are spaced apart from adjacent conductive pads by a distance of 0.80 mm or less.

18. The apparatus of claim 14, wherein the conductive pads of the module have a width of 0.60 mm or less.

* * * * *